United States Patent [19]

Adachi

[11] Patent Number: 4,768,947

[45] Date of Patent: Sep. 6, 1988

[54] BURNER APPARATUS

[75] Inventor: Ikuro Adachi, Aichi, Japan

[73] Assignee: Rinnai Corporation, Aichi, Japan

[21] Appl. No.: 36,402

[22] Filed: Apr. 9, 1987

[30] Foreign Application Priority Data

Oct. 16, 1986 [JP] Japan ..... 61-246363

[51] Int. Cl.[4] ..... F23N 5/10

[52] U.S. Cl. ..... 431/80; 126/351; 431/89; 431/90

[58] Field of Search ..... 431/80, 62, 75; 126/351

[56] References Cited

U.S. PATENT DOCUMENTS

| | | | |
|---|---|---|---|
| 2,417,667 | 3/1947 | Strobel | 431/15 |
| 3,076,495 | 2/1963 | Ray et al. | 431/15 |
| 3,630,648 | 12/1971 | Hulsman | 431/80 |
| 3,890,936 | 6/1975 | McInerney et al. | 126/351 |
| 4,125,356 | 11/1978 | Bhashi et al. | 431/80 |
| 4,583,936 | 4/1986 | Krieger | 431/75 |
| 4,588,372 | 5/1986 | Torborg | 431/75 |

*Primary Examiner*—Carroll B. Dority, Jr.

*Attorney, Agent, or Firm*—Nilsson, Robbins, Dalgarn, Berliner, Carson & Wurst

[57] ABSTRACT

A burner apparatus comprising: a burner plate on which fuel gas is ignited, a thermal sensor which generates an output voltage in response to the combustion of the fuel gas so as to detect an air component of the fuel gas, means for causing the output from the thermal sensor to correspond to the quantity of combustion on said burner plate, and a safety circuit which stops combustion on said burner plate when the output of the thermal sensor displaces from a magnitude within a certain range.

9 Claims, 6 Drawing Sheets

FIG. 2
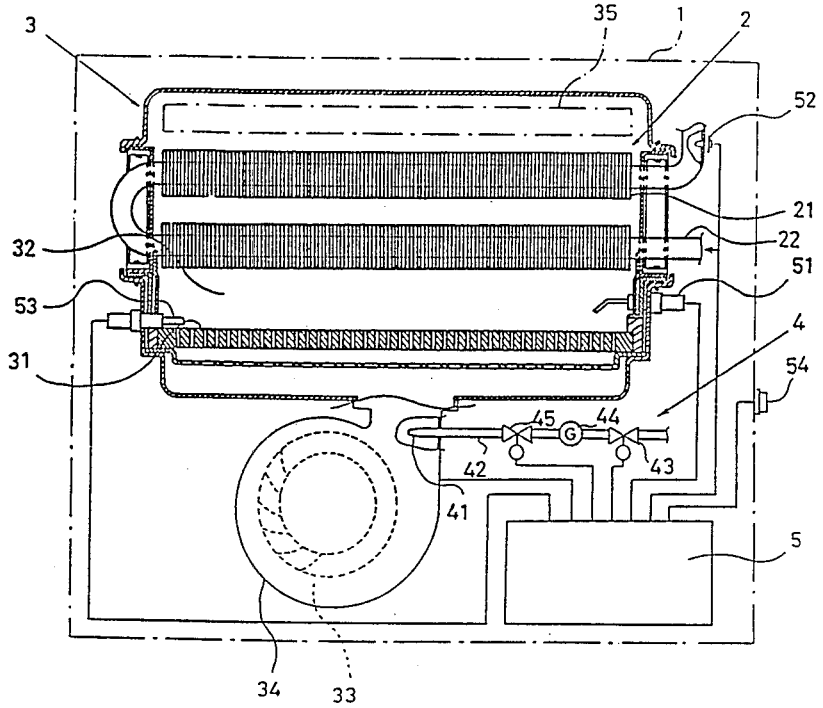
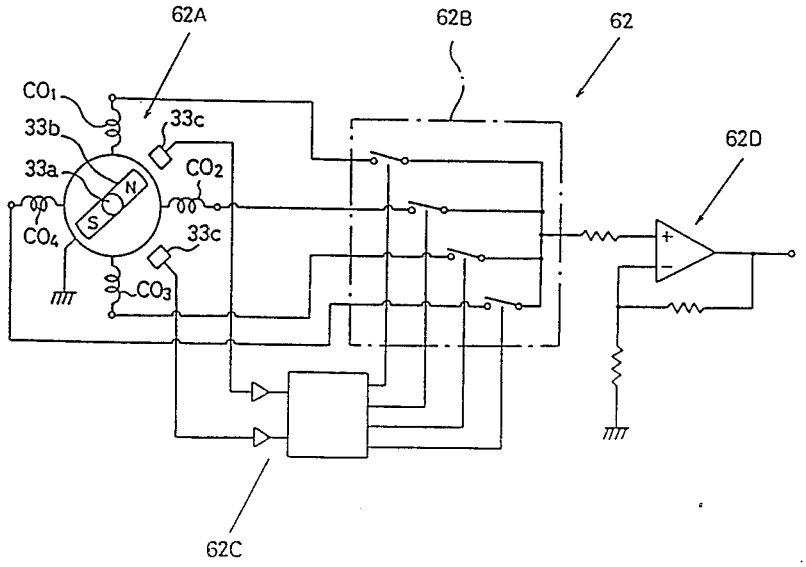
FIG. 3

FIG. 4
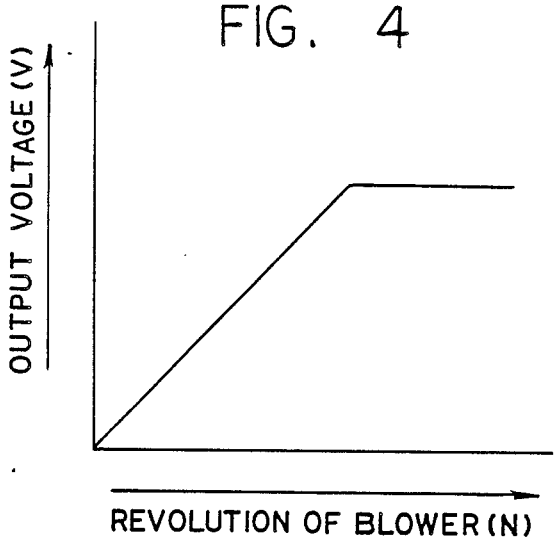
FIG. 5
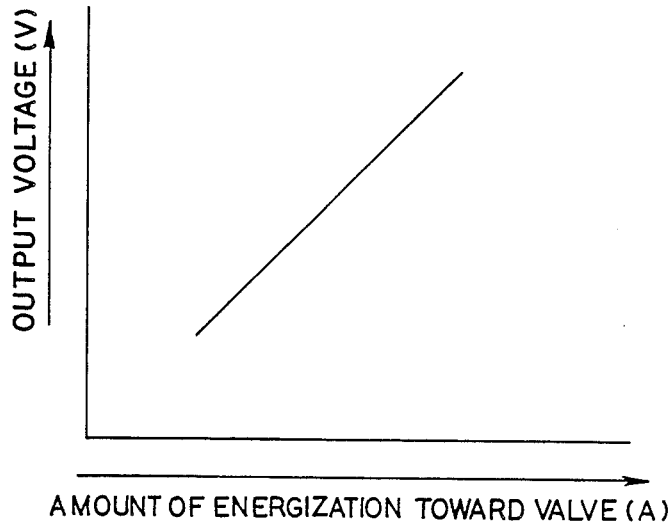
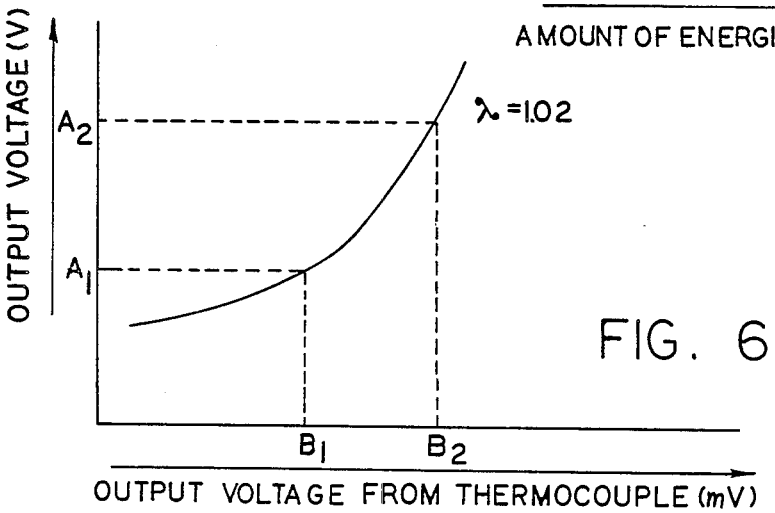
FIG. 6

BURNER APPARATUS

PRIORITY CLAIM

This application claims priority under 35 USC 119 from Japanese Patent Application Serial No. 246363/1986, filed Oct. 16, 1986.

FIELD OF THE INVENTION

The present invention relates to a burner apparatus in which combustion on a burner plate is controlled in response to the air component mixed with fuel gas.

BACKGROUND OF THE INVENTION 1. Description of the Prior Art

In this sort of apparatus, a thermocouple is provided as a thermal sensor to detect the combustive condition on a burner plate. In this instance, the thermocouple generates an output, the magnitude of which corresponds to air-fuel ratio at a certain quantity of combustion.

Therefore, the output range from the thermocouple when appropriate air-fuel ratio is obtained is previously determined at a certain quantity of combustion. In so doing, the apparatus decides the combustion to be in abnormal condition so as to interrupt it when the thermocouple generates the output exceeding to or short of the output range.

The above output range, however, displaces in response to the quantity of combustion which is liable to change during operation.

As a consequence, there is a possibility that the apparatus interrupts the combustion depending upon its quantity even though the air-fuel ratio falls within an appropriate range.

2. Summary of the Invention

It is an object of the present invention to provide a burner apparatus which is capable of positively stopping combustion on a burner plate regardless of the quantity of the combustion when air-fuel ratio deviates from within a certain appropriate range.

According to the present invention, there is provided a burner plate on which fuel gas is ignited, a thermal sensor which generates an output voltage in response to the combustion of the fuel gas so as to detect an air component of the fuel gas, means for causing the output from the thermal sensor to correspond to the quantity of combustion on the burner plate, and a safety circuit which stops the combustion on the burner plate when the output of the thermal sensor displaces from a magnitude within a certain range. With this structure, a burner apparatus is able to positively stop combustion on a burner plate regardless of the quantity of the combustion when the air-fuel ratio deviates from a predetermined magnitude.

BRIEF DESCRIPTION OF THE DRAWINGS

Various other objects, features and attendant advantages of the present invention will be more fully appreciated as the same becomes better understood from the following detailed description when considered in conjunction with the accompanying drawings, in which like reference characters designate corresponding parts throughout the several views and wherein:

FIG. 2 is a schematic view of a water heater;

FIG. 3 is an electrical wiring diagram of a revolution detecting circuit;

FIG. 4 is a graph showing the relationship between the revolution of the blower to the water heater and the output from the revolution detecting circuit;

FIG. 5 is a graph showing the relationship between the output of the revolution detecting circuit and electrical current supplied to a proportional directional valve;

FIG. 6 is a graph showing the normal output of a thermocouple against output of the revolution detecting circuit;

DETAILED DESCRIPTION OF THE PREFERRED EMBODIMENTS

Figure 1:
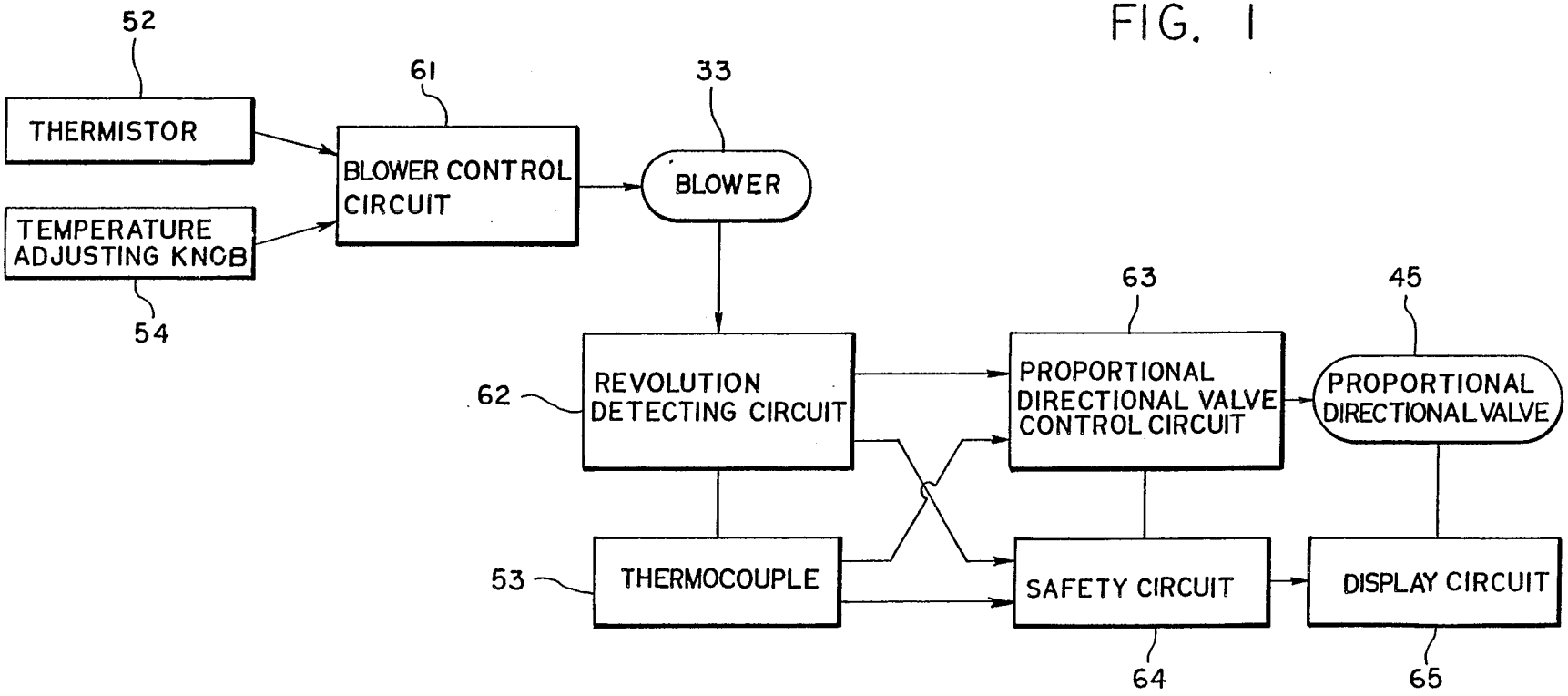
FIG. 1 is a block diagram of a control circuit according to a first embodiment of the invention.

Referring now to the drawings and more particularly to FIG. 2 thereof, in which a gas water heating device 1 is schematically shown, the heating device 1 incorporated with the present invention includes a burner portion 3 having a thermal exchanger 2, a flammable gas supply circuit 4, and an electronic control circuit 5. The burner portion 3 has a chamber 32 in which a ceramic burner 31 is placed. Under the chamber 32, there is provided an air supply portion 34 into which a blower 33 is incorporated. Above the chamber 32, there is an exhaust opening 35 through which exhaust gas from the burner 31 passes. The thermal exchanger 2 has a water conduit 22 carrying a series of fins 21, allowing heat to be imparted with the water flowing from the upper reach of the conduit 22 so as to supply hot water.

The gas supply conduit 4 has a nozzle 41 which ejects flammable gas through a gas supply pipe 42. At the upper reach of the gas supply pipe 42, a valve 43 is provided to be energized and deenergized for opening and closure. At the lower reach of the valve 43, a governor valve 44 is arranged to adjust flow of the gas. A porportional directional valve 45 is disposed at the lower reach of the governor valve 44 to change its opening degree according to supplied electrical current.

An electronic control circuit 5 includes a pair of spaced electrodes 51 disposed on the burner plate 31 to build a spark therebetween at the time of igniting the gas. A thermocouple 53 is provided as a thermal sensor above the burner plate 31 to detect the air-fuel ratio by means of the electronic control circuit 5. A thermistor 52 is attached to the water supply pipe 22 of the thermal exchanger 2 so as to be controlled by the electronic control circuit 5. The circuit 5 controls the temperature of the water coming from the supply pipe 22 of the thermal exchanger 2 when operated by means of a knob 54, so that a blower 33, valve 43 and a proportional directional valve 45 work as designed.

Reference is now made to FIG. 1, which shows how the proportional directional valve 45 is controlled at its opening degree, and how the blower 33 is controlled at its amount of air flow. According to FIG. 1, a blower control circuit 61 which acts as a temperature adjustment circuit is provided to adjust the temperature of hot water flowing through the supply pipe 22. This is accomplished by comparing output signal from the thermistor 52 with the reference voltage from operation of the knob 54 to control the amount of energization against the blower 33. A revolution detecting circuit 62 is provided to detect the amount of air from the blower 33 by detecting the revolution of the blower 33. A proportional directional valve control circuit 63 is provided to control the amount of fuel gas by adjusting the opening degree of the proportional directional valve 45 in response to the output from the revolution detecting circuit 62 and that from the thermocouple 53.

A safety circuit 64 is provided which deenergizes the blower 33, the electromagnetic valve 43, and the spark electrodes 51 or the like to stop the combustion on the burner plate 31 when the output from the thermocouple 53 indicates that the air-fuel ratio deviates from a certain appropriate magnitude in the course of the water heating operation. A display circuit 65 shows an operator whether the gas water heating device 1 does work or stop.

In so doing, the revolution detecting circuit 62 is comprised as shown in FIG. 3 by way of illustration. In the revolution detecting circuit 62, a brushless electric motor (not shown) is incorporated into the blower 33 in which a permanent magnet **33*b* is secured to a rotary shaft 33*a* of the motor. In addition to the magnet 33*b*, the revolution detecting circuit 62 has a hall device 33*c*, a signal generator 62A which includes coils (C01)–(C04), analogue switch means 62B, a decoder 62C, and a voltage transducer 62D. The transducer 62D changes its voltage (V) in proportion with the revolution (N) of the blower 33 within the range of a certain voltage as seen in FIG. 4. The valve control circuit 63 determines the amount of energization (A) toward the proportional directional valve 45 according to the output voltage (V) from the revolution detecting circuit 62 as seen in FIG. 5. The valve control circuit 63 further makes up for the amount of the energization toward the valve 45, so that appropriate amount of fuel gas and that of air is supplied to the burner plate 31** to maintain the normal air-fuel ratio.

OPERATION

With the structure thus far described, the electronic control circuit 5 works as follows: Operation of the knob 54 changes the reference voltage is response to the output from the thermistor 52, so that the blower control circuit 61 instantaneously changes its output voltage so as to determine the revolution of the blower 33. The revolution change of the blower 33 varies the output voltage (V) of the revolution detecting circuit 62 so as to determine the amount of energization toward the proportional directional valve 45 in accordance with FIG. 5.

That is to say, the operation of the knob 54 substantially changes both the revolution of the blower 33 and the opening degree of the proportional directional valve 45 instantaneously, so that the hot water of desired temperature is quickly served. With the instantaneous change of both the opening degree of the valve 45 and the revolution of the blower 33, the amount of air from the blower 33 and that of fuel gas is maintained in appropriate proportion to always secure a normal air-fuel ratio.

With the sensor 53 which always monitors the temperature of the hot water, and with the blower control circuit 61 which controls the proportional directional valve 63 so as to correspond the temperature by the thermistor 52 with that by the knob 54, the proportional directional valve 45 is controlled at its opening degree as quickly as the thermistor 52 detects the temperature of the hot water. This acts to compensate the temperature of the hot water which is served from the water heater 1 as determined by the knob 54. Thus there is substantially eliminated a delay time required until the water temperature catches up with that designated by the knob 54.

Meanwhile, as shown in FIG. 6, a safety circuit 64 generates an output (mV) greater than a reference voltage (with an air-fuel ratio as 1.02 for example) as determined in accordance with output voltage from the revolution detecting circuit 62 (corresponding to quantity of combustion), so as to judge the combustion on the burner plate 31 to be in abnormal condition.

This causes the blower 33 and valve 43 to deenergize in order to interrupt the combustion on the burner plate 31, and at the same time, activating the display circuit 65 to show that the burning operation has stopped.

The safety circuit 64 also stops the operation when the circuit 64 judges the air-fuel ratio (λ) to be smaller than 1.02 when the thermocouple 53 generates an output (mV) greater than the value (B1) with the output voltage (V) of the revolution detecting circuit 62 at value (A1). The safety circuit 64 further stops the operation when the circuit 64 judges the air-fuel ratio (λ) to be smaller than 1.02 when the thermocouple 53 generates an output voltage (mV) greater than the value (B2) with output voltage (V) of the revolution detecting circuit 62 at the value (A2).

As understood from above instances, the safety circuit 64 works to interrupt the combustion on the burner plate 31 in order to stop the operation, when the air-fuel ratio (λ) deviates from the predetermined value regardless of the quantity of combustion on the burner plate 31.

Figures 7, 8:
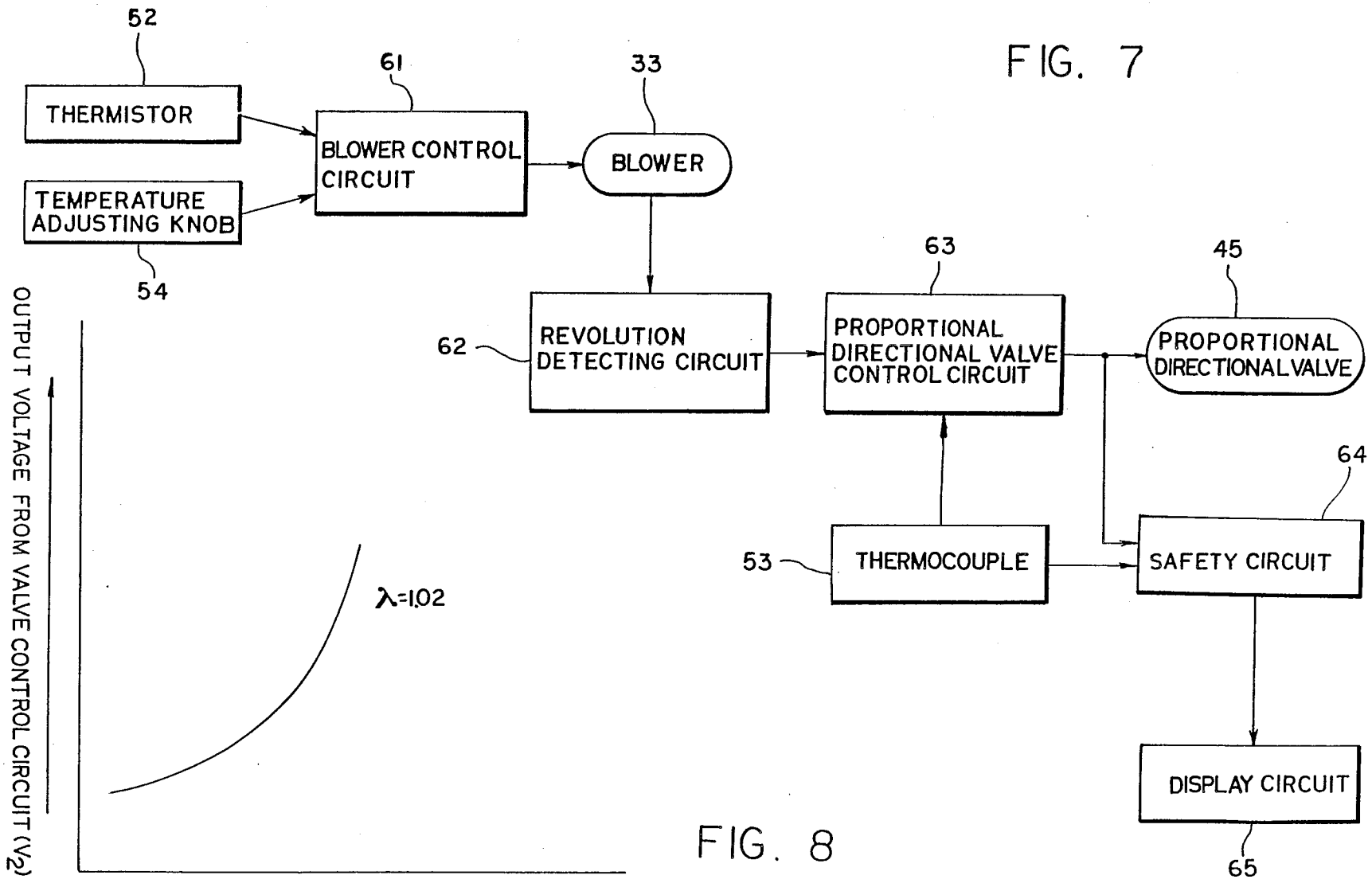
FIG. 7 is a block diagram of a control circuit according to a second embodiment of the invention.
FIG. 8 is a view similar to FIG. 6 applied to the second embodiment.

Referring now to FIG. 7, a second embodiment of the invention is shown. In this second embodiment, the quantity of combustion is detected by the output voltage (V0) from the valve control circuit 63 which controls the opening degree of the valve 45. The safety circuit 64 stops the operation of the water heater device 1 when the thermocouple 53 generates an output voltage (mV) greater than the voltage (V2) corresponding to the air-fuel ratio (λ) (see FIG. 8).

It is noted that the judgment of the safety circuit **64*f* is based upon the opening degree of the proportional directional valve 45**, so that change of air flow supply is fully compensated in opposition to the case of fuel gas.

Figure 9:
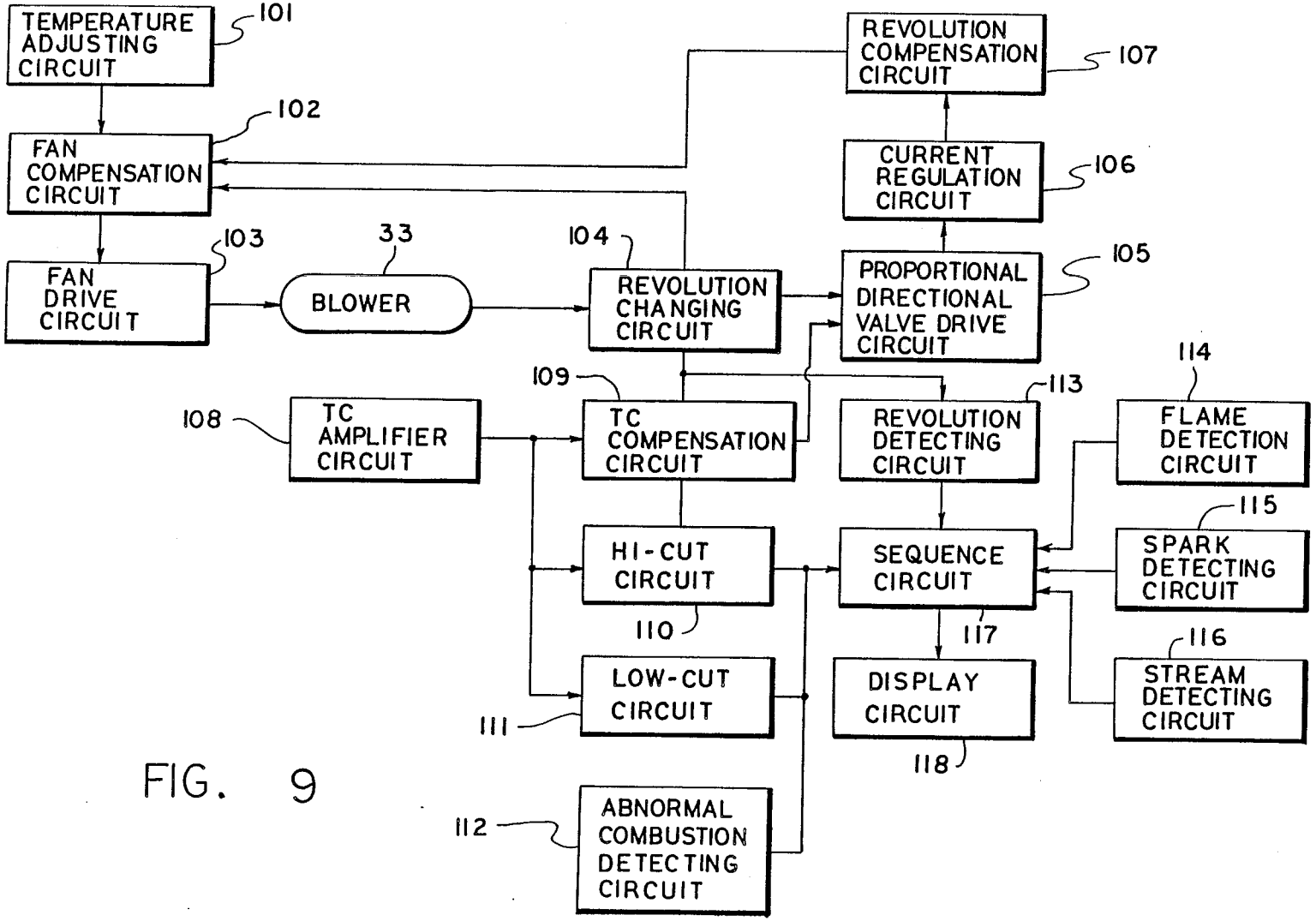
FIG. 9 is a block diagram of a control circuit according to a third embodiment of the invention.

Referring to FIG. 9, a control unit according to third embodiment of the invention is shown. The control unit has a temperature adjusting circuit 101 including an adjusting knob and a thermistor, a fan compensation circuit 102, a fan drive circuit 103, a revolution changing circuit 104 and a proportional directional valve. The control unit further has a valve drive circuit 105 which works as the proportional directional valve control circuit 63 does in the first embodiment of the invention. The control unit comprises a valve current regulation circuit 106, a revolution compensation circuit 107, a thermocouple and a thermocouple amplifier circuit 108. The unit further provides a thermocouple compensation circuit 109 which makes up for the output from the thermocouple in response to that from the revolution changing circuit 104. A hi-cut circuit 110 which serves as a safety circuit is provided together with a low-cut circuit 111, an abnormal combustion detecting circuit 112, a fan revolution detecting circuit 113, a flame detecting circuit 114, a spark detecting circuit 115, a stream detecting circuit 116, a sequence circuit 117 and a display circuit 118 which indicates whether the water heater device 1 is being operated or not.

The temperature adjusting circuit 101, a compensation circuit 102 and fan drive circuit 103 work together as the blower control circuit 61 does in the first embodiment of the invention.

Figure 10:
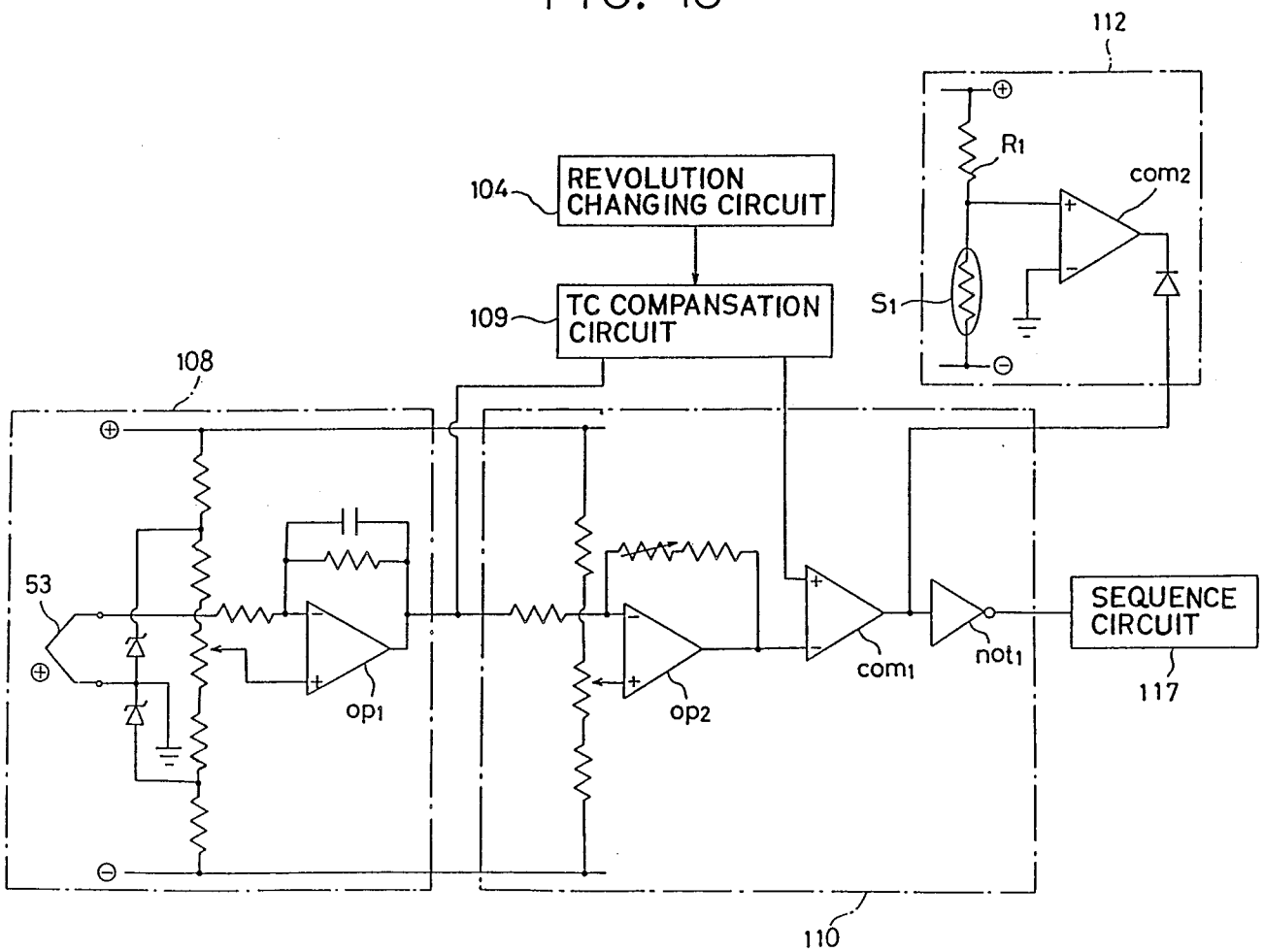
FIG. 10 is an electronic wiring diagram in connection with a thermocouple amplifier, a hi-cut circuit and an abnormal combustion detecting circuit.

FIG. 10 shows an electronic wiring diagram of the thermocouple amplifier circuit 108, the hi-cut circuit 110 and the abnormal combustion detecting circuit 112. The thermocouple amplifier circuit 108 has an operational amplifier (op1), the non-inverting input terminal which is connected to receive a reference voltage. The inverting input terminal of the amplifier (op1) is connected to a negative terminal of the thermocouple 53, the positive terminal of which is grounded. The operational amplifier thus constructed generates an output which becomes smaller as the temperature of flame, which thermocouple 53 detects, rises.

Meanwhile, the hi-cut circuit 110 has an operational amplifier (op2), a comparator (com1) and an inverter (not1). The amplifier (op2) is connected at its inverting input terminal to receive an output from the amplifier (op1) of the hi-cut circuit, while receiving a reference voltage through the non-inverting terminal. The amplifier (op2) generates an output which becomes greater as the temperature of flame, which the thermocouple 53 detects, rises. The output terminal of the amplifier (op2) is connected to the inverting terminal of the comparator (com1), to the noninverting terminal of which the output from the revolution changing circuit 104 is fed through the thermocouple compensation circuit 109. In this instance, the output from the circuit 104 rises higher as the revolution of the blower 33 increases. In so doing, the comparator (com1) generates a "hi" signal when the output from the revolution changing circuit 104 is greater than that from the amplifier (op2). The comparator (com1), on the other hand, generates a "low" signal when the output from the amplifier (op2) is greater than that from the revolution changing circuit 104. The output from the comparator (com1) is fed to the sequence circuit 117 through the inverter (not1). A "low" signal from the inverter (not1) judges the combustion to be in the normal condition so as to continue the operation. A "hi" signal from the inverter (not1) judges the combustion to be in the abnormal condition so as to interrupt the operation.

That is to say, the quantity of combustion which is previously determined by the revolution of the blower 33 is compared with that detected by the thermocouple 53 at the time of combustion. When the latter is greater than the former, the safety circuit 64 indicates through the sequence circuit 117 that the fuel gas is surplus over air flow so as to interrupt the operation. This avoids the devices 1 from being interrupted at its operation depending upon the quantity of combustion, since the predetermined air-fuel ratio is correctly detected at any combustive level on the burner plate 31.

On the other hand, the abnormal combustion detecting circuit 112 has a comparator (com2), the non-inverting terminal of which is connected to the common point of an electrical resistance (R1) and an oxygen gas sensor (S1). The inverting terminal of the comparator (com2) is grounded. The oxygen gas sensor (S1) is made from zirconium which is provided in the proximity of flame built up on the burner plate 31 and is adapted to increase its resistance with the increase of oxygen gas.

With this structure, when the quantity of oxygen gas involving the flame decreases to be smaller than the predetermined value at the time of abnormal combustion, the output from the comparator (com2) indicates a "low" signal to draw the output from the comparator (com1) of the hi-cut circuit 110 so as to introduce a "hi" signal at the output terminal of the inverter (not1), thus stopping the operation through the sequence circuit 117.

It is noted that the combustion on the burner plate 31 stops when the air-fuel ratio changes below the predetermined level through the hi-cut circuit 110 in the above embodiment, instead of the hi-cut circuit 110, the low-cut circuit 111 may be employed It is also appreciated that other means than the revolution of the blower 33 may be employed to control the opening degree of the proportional directional valve 45.

This invention may be incorporated into air warming apparatus instead of water heating apparatus of the above embodiment. It is also appreciated that other kinds of fuel such as, for example, petroleum, may be employed instead of kerosene.

The invention has been described in various forms which are intended to be explanatory and not to be taken in a limiting sense, since various changes in the parts, construction and arrangement may be effected without departing from the scope of the invention as set forth in the following claims.

What is claimed is:

1. A burner apparatus comprising:
- a housing;
- a temperature adjusting circuit with an adjusting knob;
- a burner plate on which fuel gas is ignited;
- a fuel supply which is regulated by a proportional directional valve;
- an air supply which is regulated by a blower;
- a blower control circuit for detecting blower revolutions;
- a thermal sensor which detects combustion on the burner plate and generates an output voltage proportional to the combustion;
- means for adjusting the fuel and air supplies in response to the output voltage of the thermal sensor and the revolutions of the blower by controlling the degree of openness of the proportional directional valve; and
- a safety circuit having a means for stopping combustion on the burner plate when the output of the thermal sensor deviates from a magnitude within a certain predetermined range.

2. A burner apparatus according to claim 1, in which said thermal sensor is a thermocouple.

3. A burner apparatus according to claim 1, further comprising a display means which is activated by the safety circuit to indicate that the burning operation has ceased.

4. A burner apparatus according to claim 1, wherein the means for adjusting the fuel and air supplied comprises an electronic control circuit which receives the output voltage of the thermal sensor, compares the output voltage with the output of a blower revolution detecting circuit and supplies electrical current to the proportional directional valve to adjust the amount of fuel supplied to the burner plate.

5. A burner apparatus according to claim 4, in which said thermal sensor is a thermocouple.

6. A burner apparatus according to claim 4, further comprising a display means which is activated by the safety circuit to indicate that the burning operation has ceased.

7. A burner apparatus according to claim 1, wherein the degree of openness of the proportional directional valve is controlled in response to the revolutions of the blower which supplies air to the burner plate.

8. A burner apparatus according to claim 7, in which said thermal sensor is a thermocouple.

9. A burner apparatus according to claim 7, further comprising a display means which is activated by the safety circuit to indicate that the burning operation has ceased.

* * * * *

UNITED STATES PATENT AND TRADEMARK OFFICE

CERTIFICATE OF CORRECTION

PATENT NO. : 4,768,947

DATED : September 6, 1988

INVENTOR(S) : Ikuro Adachi

It is certified that error appears in the above-identified patent and that said Letters Patent is hereby corrected as shown below:

Col. 3, line 46, after "voltage" delete "is" and insert therefor --in--

Signed and Sealed this

Twenty-fourth Day of January, 1989

*Attest:*

DONALD J. QUIGG

*Attesting Officer*

*Commissioner of Patents and Trademarks*